US006152751A

United States Patent [19]

Hanson et al.

[11] Patent Number: 6,152,751

[45] Date of Patent: Nov. 28, 2000

[54] SHIELDED PIN CONNECTOR AND SHIELD

[75] Inventors: Ralph E. Hanson, Arlington; Stephen Cupp, Lexington, both of Mass.

[73] Assignee: Pace Medical Inc., Waltham, Mass.

[21] Appl. No.: 09/302,827

[22] Filed: Apr. 30, 1999

[51] Int. Cl.[7] ..... H01R 13/15

[52] U.S. Cl. ..... 439/263; 439/732; 439/694

[58] Field of Search ..... 439/263, 732, 439/694, 259, 133, 264, 578–585

[56] References Cited

U.S. PATENT DOCUMENTS 5,073,124 12/1991 Powell ..... 439/263
5,514,001 5/1996 Szegda ..... 439/263
5,904,587 5/1999 Osypka ..... 439/263

*Primary Examiner*—Neil Abrams
*Assistant Examiner*—J. F. Duverne
*Attorney, Agent, or Firm*—Cesari and McKenna, LLP

[57] ABSTRACT

A shielded male pin connector (10) includes a rigid, insulating body (14), an elongated contact pin (18*a*, 18*b*) extending from the body and a cable (20) extending into the body (14) and connected electrically to the pin. To electrically isolate the pin, a flexible, resilient, electrically insulating tubular shield (32) encircles the pin, the shield being longer than the pin. The shield is rotatably mounted to the body (14) coaxial to the pin so that when the connector is coupled to a mating female connector (13) having a locking cap (28*a*, 28*b*) received in the shield (32), the locking cap may be turned by squeezing and rotating the shield (32).

14 Claims, 1 Drawing Sheet

SHIELDED PIN CONNECTOR AND SHIELD

This invention relates to an electrical connector for medical use. It relates more particularly to a pin connector of the type which establishes an electrical connection between an external electrical device such as a pacemaker and a pacing lead or other electrical component extending into a patient's body.

BACKGROUND OF THE INVENTION

One of the most common male electrical connectors for use in medical applications today consists of a rigid insulating body with one or more conductive contact pins projecting from the body. An electrical cable extending into the body has a conductor which leads to each pin. The pin connector is adapted to be coupled to a female connector having a corresponding number of receptacles arranged and adapted to receive the pins. Usually, each receptacle of the female connector comprises an exteriorly threaded post having an axial passage. A tubular splined contact lines that passage, the contact extending out beyond the post. Screwed onto the post is an interiorly threaded cap having an axial passage which is shaped and arranged so that when the cap is screwed down on the post, its squeezes the splines of that post together. Thus, when the pin of the male connector is received in the receptacle of the female connector and the cap is tightened down, the pin is captured by the splined contacts of the female connector thereby establishing a good electrical and mechanical connection between the two connectors.

A serious problem with male pin connectors of this general type is that when such connectors are disconnected, the contact pins of those connectors are completely exposed. Bearing in mind that the connector may terminate an electrical lead extending to a heart pacing lead or other device implanted in a patient, it is readily apparent that the exposed pins of the male connector constitute a potential hazard to the patient. For example, there have been cases where the pins of the male connector have been inadvertently plugged into an electrical outlet. In other instances, the pin connector has been placed on a conductive surface such that the pins are short circuited causing injury to the person carrying the implanted device connected to that connector. Indeed, enough injuries have been caused by those phenomena that various governments have mandated that the pins of the male pin connector be shielded in such a way as to avoid those problems.

SUMMARY OF THE INVENTION

Accordingly, it is an object of the present invention to provide a male pin connector whose pins are shielded against inadvertent electrical contacts.

Another object of the invention is to provide a connector of this type whose pins are electrically isolated from one another so that there is minimum likelihood of their being short circuited.

A further object of the invention is to provide a shielded pin connector which can be made and assembled relatively easily and inexpensively.

A further object of the invention is to provide a shielded pin connector which does not interfere with the normal coupling of the male connector to a mating female connector.

Yet another object of the invention is to provide a shielded pin connector which is bio-compatible and which can withstand autoclave sterilization.

A further object of the invention is to provide a shield assembly which can be retrofitted to existing male pin connectors to provide one or more of the above advantages.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, my shielded pin connector comprises a more or less standard male pin connector composed of an insulating body having one or more contact pins projecting from the body, the pins being in electrical communication with the conductors of a cable extending into the body. In order to electrically shield the connector pins from each other and from the outside world, a generally cylindrical sleeve or boot is secured to the body at the location of each pin. Each shield surrounds, and extends at least to, and preferably beyond, the free end of the associated pin so that the pins cannot inadvertently contact a conductive surface.

As we shall see, each shield is resilient and rotatable relative to the connector body so that when the male connector is coupled to a mating female connector so that the pins are received in the corresponding receptacles of the female connector, the sleeves or boots will surround the corresponding locking caps of the female connector. Yet, because the sleeves are flexible and rotatable, the locking caps can be tightened (or loosened) simply by squeezing and rotating the sleeves. Thus, the sleeves do not interfere at all with the normal locking together of the mating male and female connectors.

As will become apparent, the sleeves are relatively easy and inexpensive to make in quantity and they can be retrofit with ease to existing male pin connectors. Therefore, they should find wide acceptance in the marketplace.

BRIEF DESCRIPTION OF THE DRAWINGS

For a fuller understanding of the nature and objects of the invention, reference should be had to the following detailed description taken in connection with the accompanying drawings, in which.

DETAILED DESCRIPTION OF AN ILLUSTRATIVE EMBODIMENT

Figure 1:
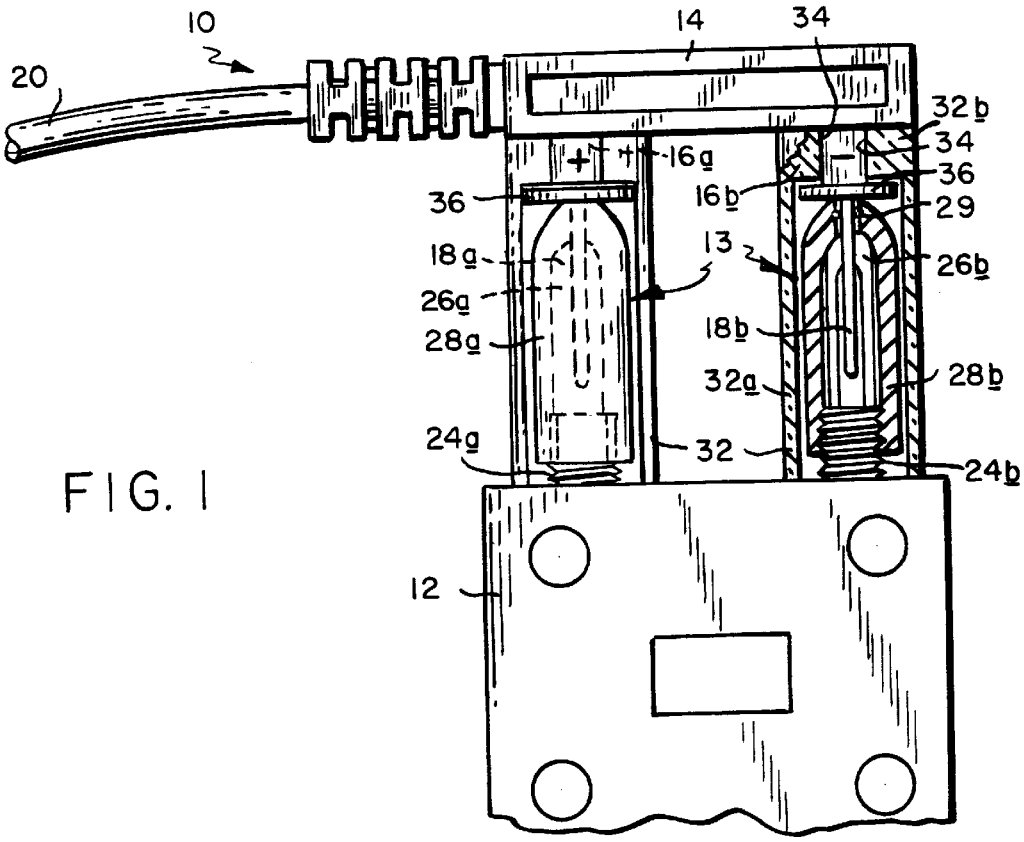
FIG. 1 is a fragmentary elevational view with parts broken away showing a shielded male pin connector incorporating the invention coupled to a mating female connector on a pacemaker.

Referring to FIG. 1 of the drawings, my shielded pin connector indicated generally at 10 is shown coupled to a conventional external pacemaker 12. The pin connector is a male-type connector comprising an elongated rigid electrically insulating body 14. Extending from spaced-apart locations along body 14 is a pair of cylindrical bosses 16*a* and 16*b* which support a pair of elongated cylindrical pins 18*a* and 18*b*. Internal electrical connections 20*a* (FIG. 2) are made between pins 18*a*, 18*b* and the conductors of a cable 20 extending from one end of body 14. In the illustrated application, cable 20 ultimately leads to a pacing electrode (not shown) for implantation in a patient's heart. Typically, the bosses 16*a*, 16*b* are color coded as indicated at 22*a* and 22*b* to establish the polarity of the connector 14.

As shown in FIG. 1, pacemaker 12 includes a female connector shown generally at 13, comprising a pair of upstanding posts 24*a* and 24*b* whose centerline spacing is more or less the same as the spacing of pins 18*a*, 18*b*. Extending up within and lining posts 24*a*, 24*b* is a pair of female contacts 26*a* and 26*b*. Each contact 26*a*, 26*b* comprises a plurality of tines which extend beyond the end of the associated posts 24*a*, 24*b* and define a splined tube whose inner diameter is more or less the same as the diameter of the pins 18*a*, 18*b*. Threaded onto the pair of posts 24*a*, 24*b* is a pair of similar locking caps 28*a* and 28*b* having end openings 29 which are aligned with the respective contacts 26*a*, 26*b*. The caps are shaped so that when they are screwed down onto their respective posts 24*a*, 24*b*, they squeeze together the free ends of the associated splined contacts 26*a*, 26*b*. Thus, when the caps 28*a*, 28*b* on posts 24*a*, 24*b*, respectively, are unscrewed or loosened, the male connector 10 may be coupled to the female connector 13 by inserting the connector pins 18*a*, 18*b* through the holes 29 in the locking caps 28*a*, 28*b*, and into the splined contacts 26*a*, 26*b* of connector 13. The pins may be locked in place by tightening the locking caps 26*a*, 26*b* on their respective posts 24*a*, 24*b*.

The structure described thus far is more or less conventional and does not have the advantages of applicant's shielded connector because the pins 26*a*, 26*b* are not isolated and, therefore, they can make contact with a conductive surface or be plugged into the wrong receptacle.

To shield each pin 18*a*, 18*b*, a shield sleeve or boot 32 is rotatably mounted to the connector body 14 at the location of each pin so that the shield encircles the pin. Each sleeve 32 is composed of a biocompatible, electrically insulating material which is able to withstand sterilization in an autoclave. One suitable material is medical grade silicone rubber.

Figure 2:
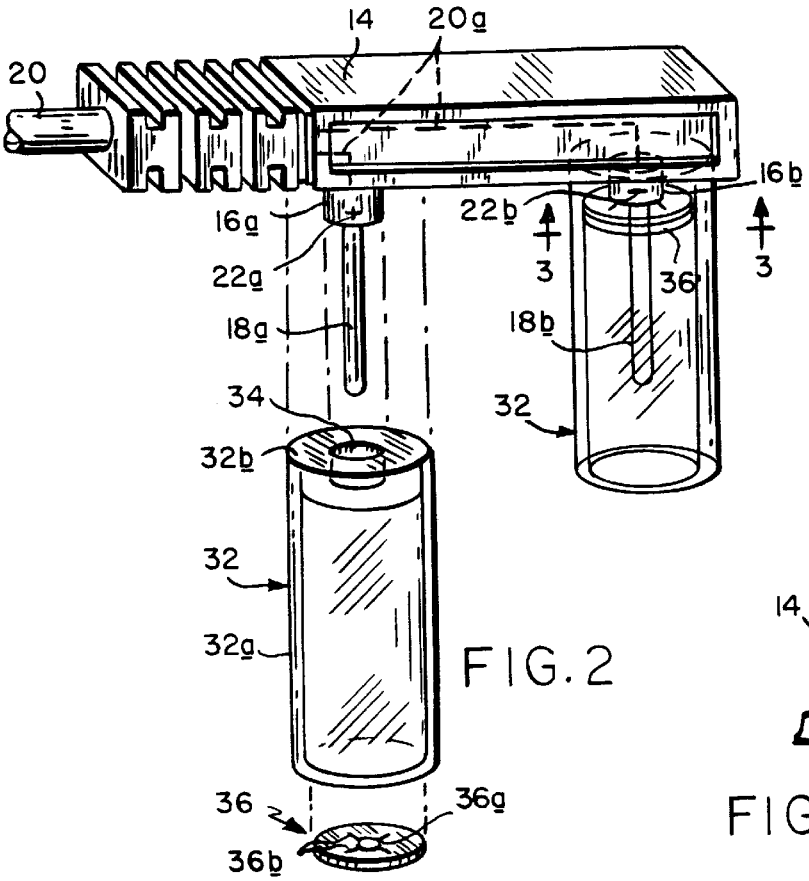
FIG. 2 is an exploded perspective view showing elements of the pin connector in greater detail.
Figure 3:
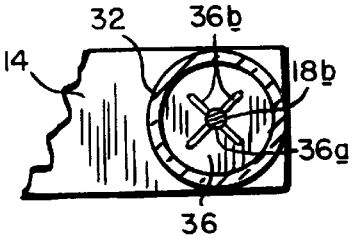
FIG. 3 is a sectional view taken along line 3—3 of FIG. 2.

As best seen in FIG. 2, each sleeve or boot 32 comprises a generally cylindrical, flexible, resilient side wall 32*a* and an end wall 32*b* having an axial through hole 34 therein. The inside diameter of side wall 32*a* should be slightly larger than the outside diameter of the locking caps 28*a*, 28*b* and the diameter of the hole 34 should be more or less the same as or slightly larger than the diameter of the bosses 16*a*, 16*b* of connector to permit rotation of each sleeve relative to the associated boss. The length of each sleeve 32 should be somewhat longer than the distance between the connector body 14 and the free ends of pins 18*a*, 18*b* so that when the sleeve or boot 32 is seated against the connector body 14 with a boss 16*a*, 16*b* projecting through the end wall hole 34 in that sleeve, the associated pin 18*b*, 18*b* will be set back from the open end of the sleeve.

Each sleeve 32 is rotatably retained on the associated boss 16*a*, 16*b* by a conventional retainer 36 made of a biocompatible material such as stainless steel and dimensional to fit inside sleeve 32. One suitable retainer is a Starlock brand push-on fastener. As is usual with such fasteners, retainer 36 has a central opening 36*a* whose diameter is slightly less than the diameter of the pins 18*a*, 18*b*. Opening 36*a* is surrounded by radial fingers 36*b* so that when a retainer 36 is slid onto the end of a pin 18*a*, 18*b*, the fingers 36*b* are deflected allowing the retainer to be slid along the pin until the retainer is adjacent to the associated boss 16*a*, 16*b* and sleeve bottom wall 32*b*. Once in place, the retainer cannot be slid in the opposite direction along the pin. Thus, the retainer 36 retains the sleeve 32 in place around the associated pin 18*a*, 18*b*. Yet the sleeve is free to rotate about its axis. Preferably, the sleeve end wall 32*b* is about as thick as the bosses 16*a*, 16*b* are long so that the ease of rotation of each sleeve 32 will depend upon how tightly the associated retainer 36 is pressed against the bottom wall 32*b* of that sleeve.

In any event, as shown in FIG. 1, when the locking caps 28*a*. 28*b* are loosened, the connector 10 may be coupled to pacemaker 12 by inserting the connector pins 18*a*, 18*b* through the holes 29 in the locking caps 28*a*, 28*b* and into the contacts 26*a*, 26*b*. The sleeves 32, being larger than the locking caps, will surround those caps as shown in FIG. 1. However, the sleeves will not prevent the locking caps from being tightened in the usual way. Since the sleeves are flexible and rotatable relative to the connector body 14, one simply squeezes each sleeve side wall 32*a* slightly so that the sleeve frictionally engages the underlying locking cap and rotates the sleeve as one would rotate the cap until the cap is tightened down on the associated post 24*a*, 24*b*.

To decouple connector 10 from pacemaker 12, one simply squeezes the sleeves 32 and rotates them in the opposite direction to release pins 18*a*, 18*b* from contacts 26*a*, 26*b*, thereby allowing the pins to be retracted from the contacts.

While not essential, it is desirable that the sleeve side walls 32*b* be more or less transparent so that an observer can still see the polarity codes 22*a*, 22*b* on the connector bosses 16*a*, 16*b*, respectively.

It will be apparent from the foregoing that the sleeves 32 do not interfere at all with the coupling of male connector 10 to connector 13 on pacemaker 12 or to any other similar mating female connector. Yet, when the connector 10 is decoupled and resting on a surface, there is no likelihood of the connector pins 18*a*, 18*b* being short-circuited by that surface. Nor is there any likelihood of the connector being plugged into the wrong receptacle because the sleeves 32 would prevent that. In other words, the female connector has to be shaped and arranged to accommodate the sleeves 32 on the male connector.

Since the sleeves 32 and their retainers 36 can be made in quantity quite inexpensively, a shielded pin connector as described herein should not cost appreciably more than a standard connector. Furthermore, sleeve 32 and retainer 36 are specifically designed so that they can be sold as a field assembly or kit and retrofit to existing male pin connectors of this type.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention described herein.

What is claimed is:

1. A shielded pin connector comprising a rigid, elongated, insulating body;

an elongated contact pin extending from the body;

a cable extending into the body and connected electrically to the pin;

a flexible, resilient, electrically insulating tubular shield, said shield having a bottom wall with a hole receiving the pin, and a side wall that is at least as long as the pin, and mounting means for rotatably mounting the shield to the body coaxial to the pin, said mounting means including a push-on fastener inside the shield and engaging the bottom wall thereof, said fastener having an axial through hole frictionally engaging the pin.

2. The connector defined in claim 1 wherein the pin and shield are cylindrical and the diameter of the shield is appreciably longer than that of the pin.

3. The connector defined in claim 2 wherein the shield is appreciably longer than the pin.

4. The connector defined in claim 1 wherein the shield is of a medical grade silicone rubber.

5. The connector defined in claim 4 wherein the shield is of a transparent or semitransparent material.

6. A shielded pin connector comprising a rigid, elongated, electrically insulating body having a bottom wall and a pair of end walls;

a pair of integral bosses extending at right angles from the bottom wall at spaced-apart locations along the body, each boss having a free end;

a pair of elongated, cylindrical contact pins extending from the free ends of the pair of bosses;

a cable extending into one end of the body, said cable having a pair of leads connected electrically to the pair of pins;

a pair of similar tubular shields, each shield encircling a different one of the pair of pins and each shield including an end wall and a cylindrical side wall whose diameter and length are longer than those of the pins, and coupling means for rotatably coupling each shield to the body coaxial to the corresponding pin.

7. The connector defined in claim 6 wherein the coupling means include means defining an axial hole in the sleeve bottom wall which rotatably receives the boss encircled by that shield, and a retainer engaged to each pin inside the corresponding shield adjacent to the free end of the corresponding boss to retain the shield end wall between the free end of the corresponding boss and the body.

8. The connector defined in claim 7 wherein the retainer comprises a push-on friction fastener frictionally engaged to the pin.

9. The connector defined in claim 6 wherein the side wall of each shield is of a see-through material.

10. The connector defined in claim 6 wherein each shield is of a medical grade plastic material.

11. A pin connector shield for rotatable coupling to a pin connector coaxial to a contact pin extending therefrom, said shield comprising a cup-like boot having a generally cylindrical, flexible, resilient side wall and a discoid bottom wall;

means defining an axial through hole in the bottom wall, and a push-on fastener having an axial through hole the hole in the fastener being smaller than the hole in the bottom wall.

12. The shield defined in claim 11 wherein said side wall is of a see-through material.

13. The shield defined in claim 11 wherein said bottom wall is thicker than said side wall.

14. The shield defined in claim 11 wherein said boot is of silicone rubber and said fastener is of stainless steel.

* * * * *